US006550381B1

(12) United States Patent
Guastaferri

(10) Patent No.: US 6,550,381 B1
(45) Date of Patent: Apr. 22, 2003

(54) TRANSFER PAD PRINTING SYSTEMS, PLATES AND METHODS

(75) Inventor: Thomas J. Guastaferri, Carol Stream, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 09/567,607

(22) Filed: May 10, 2000

(51) Int. Cl.[7] ..... B41F 9/06; B41N 1/06

(52) U.S. Cl. ..... 101/163; 101/395; 101/401.1; 101/170; 101/41

(58) Field of Search ..... 101/35, 41, 150, 101/163, 167, 169, 170, 395, 401.1, 492

(56) References Cited

U.S. PATENT DOCUMENTS

| | | | | |
|---|---|---|---|---|
| 4,301,727 A | * | 11/1981 | Bardin | 101/170 |
| 4,508,032 A | * | 4/1985 | Philipp | 101/163 |
| 4,556,462 A | | 12/1985 | Sakurai et al. | 430/302 |
| 4,557,195 A | * | 12/1985 | Phlipp | 101/163 |
| 4,936,911 A | | 6/1990 | Roberts et al. | 75/238 |
| 5,578,364 A | * | 11/1996 | Drew, II et al. | 101/163 |
| 5,806,419 A | * | 9/1998 | Adner et al. | 101/35 |
| 5,893,326 A | * | 4/1999 | Wong | 101/170 |

FOREIGN PATENT DOCUMENTS

| | | | |
|---|---|---|---|
| DE | 28 41 957 A1 | * | 4/1980 |
| DE | 35 08 920 | * | 9/1986 |
| EP | 0 473 947 | * | 3/1992 |
| FR | 2 451 829 | * | 11/1980 |

OTHER PUBLICATIONS

Trans Tech America, Inc., "An Introduction to Transfer Pad Printing", 1997, 4 pg. Brochure.
Uddeholm, "Advanced applications of cold rolled precision Strip Steel", Dec. 16, 1999, 3 pgs. (Http://www.uddeholm-.com/USAB/products.htm).

* cited by examiner

*Primary Examiner*—Leslie J. Evanisko
(74) *Attorney, Agent, or Firm*—Lisa M. Soltis; Mark W. Croll; Donald J. Breh

(57) ABSTRACT

A transfer pad printing systems, pad printing plates and methods therefor including forming a metal plate having a Rockwell C scale hardness not less than approximately 55 and a thickness between approximately 0.015 inches and approximately 0.020 inches, preferably from a cold rolled strip steel, etching an image on the metal plate and mounting the metal plate on a base plate prior to transferring images therefrom with a transfer pad.

15 Claims, 1 Drawing Sheet

TRANSFER PAD PRINTING SYSTEMS, PLATES AND METHODS

BACKGROUND OF THE INVENTION

The invention relates generally to transfer pad printing systems, and more particularly to pad printing plates and methods therefor.

Transfer pad printing is a process of transferring ink images formed on etched printing plates, known as cliches, onto products with printing pads. Transfer pad printing is particularly suitable for printing on non-flat or irregular surfaces, for example on golf balls.

One known type of pad printing plate comprises a hardened and relatively thick steel plate, for example about 10 mm thick with a Rockwell C scale hardness of approximately 65. A surface of the steel plate is ground and polished, or lapped, to provide a relatively flat and smooth surface on which an image is formed or etched by means well known in the art.

The referenced hardened and relatively thick steel pad printing plates have the advantage of being very durable with an operating life expectancy of over one million or more printing cycles. These hardened thick steel pad printing plates however are costly to manufacture, particularly the grinding and lapping operations performed thereon. The plates also have a very high raw material cost. Moreover, these plates are heavy and bulky, and thus difficult to handle and costly to ship and store.

Another known type of pad printing plate comprises a relatively thin metal foil disposed on a base substrate. Thin metal foil plates however are relatively soft, with a Rockwell C scale hardness of about 44, and thus have a comparatively limited life expectancy.

BRIEF SUMMARY OF THE INVENTIONS

An object of the present invention is to provide novel transfer pad printing systems, pad printing plates, combinations thereof and methods therefor that improve upon and overcome problems in the art.

Another object of the invention is to provide novel transfer pad printing systems, pad printing plates, combinations thereof and methods therefor that are economical.

A further object of the invention is to provide novel transfer pad printing systems and pad printing plates therefor having reduced weight and relatively good durability.

A more particular object of the invention is to provide novel transfer pad printing systems and pad printing plates therefor comprising a metal plate having a Rockwell C scale hardness not less than approximately 55 and a thickness between approximately 0.015 inches and approximately 0.020 inches.

Another more particular object of the invention is to provide novel transfer pad printing plates and methods therefor comprising etching an image on an upper surface of a metal plate having a Rockwell C scale hardness not less than approximately 55 and a thickness between approximately 0.015 inches and approximately 0.020 inches, and mounting a lower surface of the metal plate on a mounting surface of a base plate.

These and other objects, aspects, features and advantages of the present invention will become more fully apparent upon careful consideration of the following Detailed Description of the Invention and the accompanying Drawings, which may be disproportionate for ease of understanding, wherein like structure and steps are referenced generally by corresponding numerals and indicators.

DETAILED DESCRIPTION OF THE INVENTION

Figure 1:
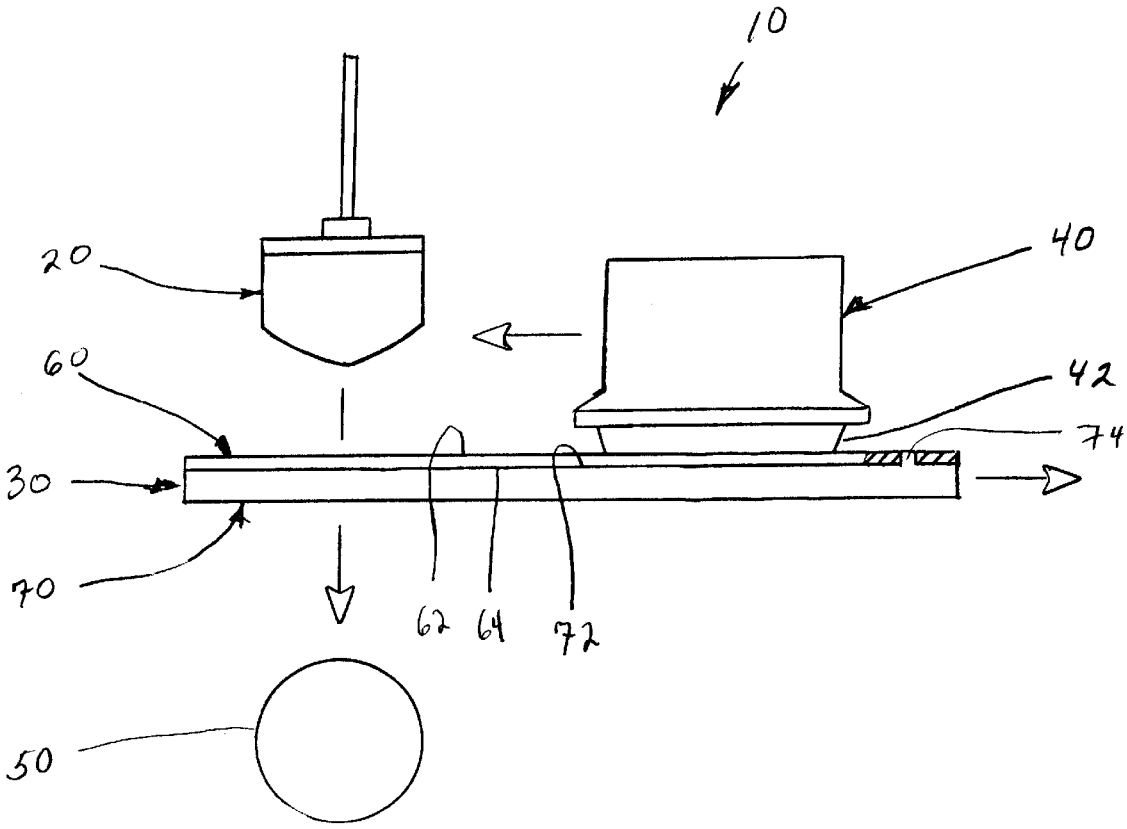
FIG. 1 is a partial view of an exemplary transfer pad printing system.

FIG. 1 is an exemplary transfer pad printing system 10 comprising generally a transfer pad 20, a pad printing plate 30, and a sealed ink cup 40 having an open end with a substantially annular scraper blade 42 disposed on the pad printing plate.

The pad printing plate 30 has an image formed or etched on a surface thereof, and the ink cup 40 is movable back and forth across the plate to deposit ink from an ink well thereof onto the image of the plate 30.

The transfer pad 20 is movable toward and away from the plate 30 to pick-up an ink image therefrom and to transfer the image onto a print medium 50, for example a golf ball. In the exemplary embodiment, the printing plate 30 moves away from the path of the transfer pad 20 to permit transfer of the ink image from the pad 20 onto the print medium 50.

The pad printing plate 30 comprises a metal plate 60 with a top surface 62 and an opposite, and preferably parallel, bottom surface 64 disposed on a mounting surface 72 of a relatively rigid base plate 70.

In the exemplary embodiment, the base plate 70 includes one or more alignment pins 74 protruding from the mounting surface 72 thereof. The pins are disposed in corresponding apertures of the metal plate 60.

The metal plate 60 preferably has a Rockwell C scale hardness not less than approximately 55 and a plate thickness in a range between approximately 0.015 inches and approximately 0.020 inches. In one exemplary embodiment, the metal plate 60 has a Rockwell C scale hardness of approximately 55 and a thickness of approximately 0.015 inches.

The top surface 62 of the metal plate 60 preferably has a flatness variation in a range between approximately 0.001 inches and approximately 0.010 inches. The top surface preferably has a smoothness variation in a range between approximately 2 rms microinches and approximately 6 rms microinches.

The bottom surface 64 of the metal plate is preferably parallel to the top surface 62 thereof with a parallelism therebetween in a range between approximately 0.0005 inches and approximately 0.0010 inches. The bottom surface 64 of the plate 60 preferably has a smoothness variation in a range between approximately 2 rms microinches and approximately 6 rms microinches.

The metal plate 60 is formed preferably of a cold rolled strip steel. Strip steels in roll form suitable for this application are available from Uddeholm, Brunswick, Ohio, for example the cold rolled precision strip steels developed thereby for coater blade and printing doctor blade and other applications.

The mounting surface 72 of the base plate 70 preferably has a flatness variation in a range between approximately 0.0001 inches per 4 inches and approximately 0.005 inches per 4 inches, and a smoothness variation in a range between approximately 8 rms microinches and approximately 10 rms microinches.

The mounting surface 72 of the base plate 70 may be ground and polished by processes known to those of ordinary skill in the art to provide the preferred surface characteristics. And since the base plate 70 is reusable, the costly grinding and polishing operations performed thereon are not required every time the etched metal plate 60 is replaced.

Figure 2:
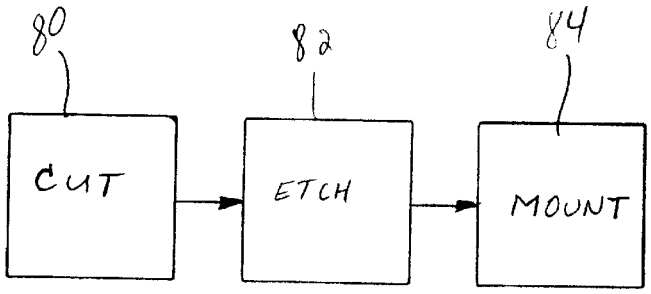
FIG. 2 is a transfer pad printing plate process flow diagram.

FIG. 2 is a process flow diagram for a transfer pad printing plate comprising generally metal plate forming, etching and mounting operations 80, 82 and 84, respectively. These exemplary operations however are not necessarily performed in the order illustrated.

The planar metal plate 60 is preferably cut to size from a cold rolled strip steel roll having the hardness, thickness and surface smoothness and flatness characteristics discussed above, thereby eliminating the costly grinding and polishing operations required in the formation of prior art metal plates.

An aperture is also formed in the metal plate 60, either during or after cutting, to accommodate the alignment pins 74 of the base plate, for example in a stamping operation, which is relatively cost effective compared to the drilling or milling operation required to form similar apertures in the relatively thick prior art metal plates mounted on base plates.

An image may be etched on the metal plate by processes well known to those of ordinary skill, either before and preferably after the relatively thin metal plate is cut from the steel strip roll.

While the foregoing written description of the invention enables one of ordinary skill to make and use what is considered presently to be the best mode thereof, those of ordinary skill will understand and appreciate the existence of variations, combinations, and equivalents of the specific exemplary embodiments herein. The invention is therefore to be limited not by the exemplary embodiments herein, but by all embodiments within the scope and spirit of the appended claims.

What is claimed is:

1. A transfer pad printing plate comprising:

a metal plate having a top surface and a bottom surface, the metal plate having a Rockwell C scale hardness not less than approximately 55, and a thickness between approximately 0.015 inches and approximately 0.020 inches, a base plate having a mounting surface, the bottom surface of the metal plate disposed on the mounting surface of the base plate, the top surface of the metal plate having a flatness variation between approximately 0.001 inches and approximately 0.010 inches, the top surface of the metal plate having a smoothness between approximately 2 rms microinches and approximately 6 rms microinches.

2. The printing plate of claim 1, the mounting surface of the base plate having a flatness variation between approximately 0.0001 inches per 4 inches and approximately 0.0005 inches per 4 inches, the mounting surface of the base plate having a smoothness variation between approximately 8 rms microinches and approximately 10 rms microinches, the top and bottom surfaces of the metal plate having a parallelism between approximately 0.0005 inches and approximately 0.001 inches, the bottom surface of the metal plate having a smoothness variation between approximately 2 rms microinches and approximately 6 rms microinches.

3. The printing plate of claim 1, wherein the metal plate is a cold rolled steel.

4. The printing plate of claim 3, wherein the metal plate has a Rockwell C scale hardness of approximately 55.

5. The printing plate of claim 1, wherein the mounting surface of the base plate is ground and polished.

6. The printing plate of claim 1, wherein the metal plate is planar.

7. A transfer pad printing system comprising:

a transfer pad;

a pad printing plate having a metal plate with opposite top and bottom surfaces, the metal plate having a Rockwell C scale hardness not less than approximately 55 and a thickness between approximately 0.015 inches and approximately 0.020 inches, the top surface of the metal plate having a flatness variation between approximately 0.001 inches and approximately 0.010 inches, the top surface of the metal plate having a smoothness variation between approximately 2 rms microinches and approximately 6 rms microinches;

the pad printing plate having a base plate with a mounting surface, the bottom surface of the metal plate disposed on the mounting surface of the base plate;

a sealed ink cup having an open end with a substantially annular scraper blade disposed thereon, the scraper blade disposed on the top surface of the metal plate.

8. The system of claim 7, wherein the mounting surface of the base plate having a flatness variation between approximately 0.0001 inches per 4 inches and approximately 0.0005 inches per 4 inches, the mounting surface of the base plate having a smoothness variation between approximately 8 rms microinches and approximately 10 rms microinches, the top and bottom surfaces of the metal plate having a parallelism between approximately 0.0005 inches and approximately 0.001 inches, the bottom surface of the metal plate having a smoothness variation between approximately 2 rms microinches and approximately 6 rms microinches.

9. The system of claim 7, wherein the metal plate is a cold rolled steel.

10. The system of claim 7, wherein the metal plate has a Rockwell C scale hardness of approximately 55 and a thickness of approximately 0.015 inches.

11. The system of claim 7, wherein the mounting surface of the base plate is ground and polished.

12. A method for making a transfer pad printing plate, comprising:

etching an image on an upper surface of a metal plate having a Rockwell C scale hardness not less than approximately 55 and a thickness between approximately 0.015 inches and approximately 0.020 inches;

mounting a lower surface of the metal plate on a mounting surface of a base plate, the upper and lower surfaces of the metal plate having a smoothness variation between approximately 2 rms microinches and approximately 6 rms microinches, the upper and lower surfaces of the metal plate having a flatness variation between approximately 0.001 inches and approximately 0.010 inches.

13. The method of claim 12, further comprising cutting the metal plate from a cold rolled steel sheet.

14. The method of claim 12, further comprising flattening the mounting surface of the base plate to a flatness variation between approximately 0.0001 inches per 4 inches and approximately 0.0005 inches per 4 inches, and smoothing the mounting surface of the base plate to a smoothness variation between approximately 8 rms microinches and approximately 10 rms microinches before mounting the metal plate.

15. The method of claim 14, wherein the flattening of the mounting surface comprises grinding and the smoothing of the mounting surface comprises lapping.

* * * * *